United States Patent [19]

Stearns

[11] 4,359,929

[45] Nov. 23, 1982

[54] NEGATIVE RATE COMPENSATED HYDRAULIC SERVO SYSTEM

[75] Inventor: Charles F. Stearns, East Longmeadow, Mass.

[73] Assignee: United Technologies Corporation, Hartford, Conn.

[21] Appl. No.: 69,140

[22] Filed: Aug. 23, 1979

[51] Int. Cl.[3] ..... F15B 13/16; F15B 15/17

[52] U.S. Cl. ..... 91/47; 91/387; 91/417 R; 91/416; 137/82

[58] Field of Search ..... 91/51, 47, 387, 388, 91/417 R, 416; 137/82, 85

[56] References Cited

U.S. PATENT DOCUMENTS

| | | | |
|---|---|---|---|
| 2,911,991 | 11/1959 | Pearl | 137/85 |
| 2,920,639 | 1/1960 | Higgins, Jr. et al. | 137/82 |
| 2,995,116 | 8/1961 | Dobbins | 91/51 |
| 3,139,922 | 7/1964 | Peczkowski | 91/387 |
| 3,171,330 | 3/1965 | McCombs, Jr. | 91/388 |
| 3,313,212 | 4/1967 | Baker et al. | 91/387 |
| 3,393,606 | 7/1968 | Magnoni et al. | 91/47 |
| 3,491,652 | 1/1970 | Riggs | 91/47 |

*Primary Examiner*—Paul E. Maslousky
*Attorney, Agent, or Firm*—Robert E. Greenstein

[57] ABSTRACT

A flapper valve having a negative rate characteristic is variably opened by an external force and controls fluid pressure to a piston which moves, in response to this pressure, in order to return the valve to a null position. A positive rate flapper valve applies force to the negative rate flapper valve and balances the fluid pressure in the negative rate flapper valve, thus providing high sensitivity negative flapper valve operation in the null position region and a negative rate in the region to overcome piston friction, without instability.

2 Claims, 2 Drawing Figures

NEGATIVE RATE COMPENSATED HYDRAULIC SERVO SYSTEM

CROSS-REFERENCE TO RELATED APPLICATIONS

The apparatus described herein may be used with the following copending, commonly owned applications which were filed on like date herewith: ELECTRONIC FUEL CONTROL SYSTEM AND METHOD By Martin, Ser. No. 69,142 now U.S. Pat. No. 4,296,601; HYDROMECHANICAL FUEL CONTROL WITH INDEPENDENT ELECTROMECHANICAL INTERFACE by Stearns, Ser. No. 69,139, now U.S. Pat. No. 4,267,693; and GOVERNORLESS GAS TURBINE FUEL CONTROL by Stearns et al, Ser. No. 69,141.

BACKGROUND OF THE INVENTION

This invention relates to hydraulic servos.

A typical servo senses movement to control fluid flow through a valve which regulates hydraulic pressure on one side of the piston which is connected to the valve by a spring. The piston moves in response to the error signal produced by the sensed movement and causes the valve to close to a null position at a piston equilibrium position.

In an ideal, completely frictionless servo system, as soon as the valve opens slightly, the piston begins to move to reestablish the valve in the null position. But since actual systems are not frictionless, it is necessary for the valve to open enough for the piston to develop force to overcome friction. The valve and the apparatus interconnecting it with the sensed movement should have a positive rate, for goof servo stability. But to establish some additional valve opening in response to sensed movement to overcome friction, a negative rate (overshoot) must be introduced, although the overall rate must still be positive.

An example of a technique for meeting these objectives is taught in my U.S. Pat. No. 3,757,639, titled NEGATIVE HYDRAULIC RATE DEVICE, which issued on Sept. 11, 1973 and is commonly owned herewith. There the negative rate is established through the use of a bellows which senses the hydraulic pressure established by a positive rate flapper valve. The bellows oppose valve movement with an opposing force that decreases with increasing valve flow, thus providing a negative rate to overcome friction.

SUMMARY OF THE INVENTION

Objects of the present invention include providing a servo system with negative rate compensation without the use of bellows.

In accordance with the present invention, the servo is given an overall positive rate by a positive rate flapper valve whose pressure drops as the flapper opens in response to the movement sensed by the servo. The force from this positive rate valve is used to balance against the force applied in the opposite direction by a negative rate flapper valve which controls the hydraulic pressure to the piston. The two valves work together to provide a balanced movement sensing system which in the null region requires miniscule force to modulate the valves. Since the negative rate flapper valve controls fluid pressure on the servo piston, it provides a negative rate or overshoot necessary to overcome friction, yet the force needed to open the valve is clamped at the force associated with the fluid pressure needed to overcome piston friction, even though there is a negative rate (from the negative flapper) in the null region. The overall system rate is determined, however, by the positive rate flapper valve because the force it exerts is not likewise clamped. In the null or equilibrium position the negative rates cancel and little or no force is needed to operate the valves, even though a negative rate is imposed therein to provide the overshoot in fluid pressure.

A feature of the invention is that it provides a servo system having miniscule force requirements in the null region, thus giving it extreme accuracy.

Another feature is that it provides a servo system having a high positive rate, thus making it extremely stable.

Still another feature is that the positive and negative rate valves are extremely reliable.

Other objects, benefits and features of the invention may be obvious to one skilled in the art from the following drawing, detailed description and claims.

DETAILED DESCRIPTION

Figure 1:
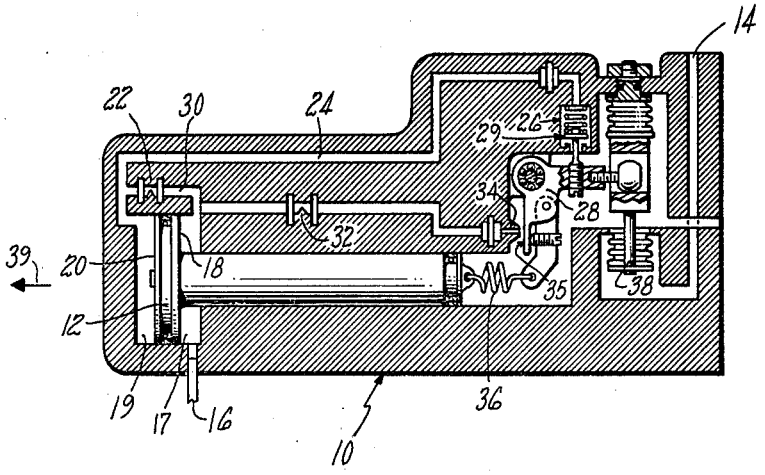
FIG. 1 is an elevation, partly in section, of a hydraulic servo system embodying the present invention.

FIG. 1 shows a hydraulic servo 10 in which a piston 12 is displaced in response to pneumatic fluid pressure on a fluid inlet 14. Hydraulic fluid is supplied under pressure through an inlet 16 to a chamber 17 that interfaces with one side 18 of the piston. The area of this side 18 is one-half the area of its opposite side 20 which is disposed in a chamber 19 that receives the hydraulic fluid through a fixed orifice 22. Fluid flows from the orifice 22 over a line 24 to a negative rate flapper valve 26 whose opening is varied in response to the movement of an arm 28 that is connected to the flapper 29 in the valve 26. Hydraulic fluid from the high pressure side 30 of the orifice 22 flows through another orifice 32 to a positive rate flapper valve 34 whose opening is likewise varied in response to movement of the arm 28 which connects to the valve flapper 35 in the valve 34. A spring 36 provides mechanical interconnection between the piston 20 and the arm 28. The sensed pressure on the port 14 is applied to a bellows 38 which pushes on the arm 28 so as to cause the arm to move counterclockwise as pressure increases and clockwise as it decreases.

The piston 20 is in equilibrium when the pressure exerted on the side 20 equals one-half the pressure exerted on the side 18; this occurs when there is a specific equilibrium flow through the orifice 22. This flow is determined by the opening of the negative rate valve 26, and it produces pressure on the valve 26 which urges the arm 28 in the clockwise direction. Fluid flows through the orifice 32 to the positive flapper valve 34 which thereby exerts counterclockwise force on the arm. In an arm null region the servo is at rest or in equilibrium and the forces from the valves 26, 34 on the arm counteract, thus removing any bias thereon in the clockwise or counterclockwise directions as the result of pressure variations associated with the fluid supplied to the inlet 16.

If the bellow 38 is pushed upward, it opens the flapper valve 26 causing increased flow through the orifice 22 which reduces the pressure on the side 20 of the piston, thus causing the piston to move to the left direction 39. Upward movement of the plunger 38 also opens the valve 34 and causes increased flow through the orifice 32, thus producing a reduction in the force applied by the valve 34 to the arm 28 by the fluid pressure on the flapper 35.

Figure 2:
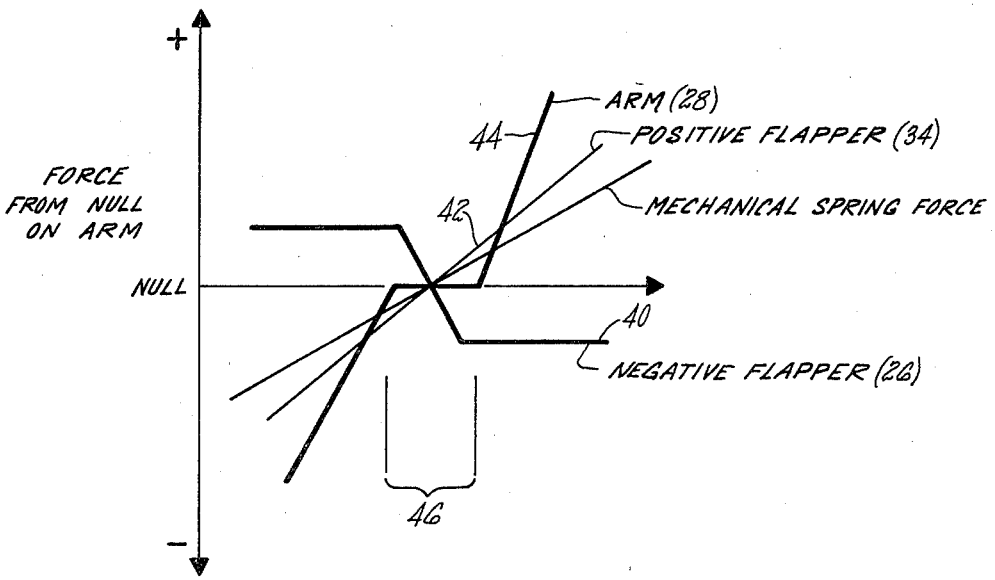
FIG. 2 is a graph which shows the mechanical rate curve for the system and the positive and negative rate valves used therein.

As shown by the curve 40 in FIG. 2, as the valve 26 opens, the force required to open it decreases until reaching a constant level which corresponds to the fluid pressure required to overcome friction on the piston 12. In other words, once the piston starts moving (once friction is overcome) the pressure in the line 24 will be constant; this response gives rise to the negative slope associated with the force required to open and close the valve 26 when the arm is in its null position, this being the position when the servo is at rest. The negative slope between the two constant points should be noted as being a reflection of the fact that the force needed to open the valve varies inversely with the valve opening. This results in fluid pressure that acts on the flapper in such a manner as to force it closed; the force being greatest just before it completely closes. As shown by the curve 42, the valve 34, on the other hand, operates in an exactly opposite fashion the fluid pressure tends to push the flapper away; consequently, it has a positive slope as shown in FIG. 2. Moreover, because it receives fluid from the supply pressure side of the servo through the orifice 32, it does not have a constant force limit. The plunger and spring provide positive mechanical rates as shown in FIG. 2.

The overall rate for the arm 28, therefore, is the summation of these rates and is defined as the curve 44 which has a zero force region 46 in the null region; in the zero force region no force is required to open or close the valves.

This curve 44 has a high positive rate, although within the range of the zero force region the valve 26 exhibits the negative slope which allows the servo to overcome friction. In essence this means that when the bellow 38 is pushed up or down, the arm will rotate until the pressure on the valve 26 is constant, which occurs once piston friction is overcome; thereafter the piston moves.

The foregoing is a detailed description of a preferred embodiment of the present invention and, hence, may suggest, to one skilled in the art, modifications and variations therein and thereto without departing from the true scope and spirit of the invention embodied therein and described in the following claims:

I claim:

1. A hydraulic servo system comprising a piston which moves in response to hydraulic fluid pressure and a valve apparatus which is resiliently connected to the piston and which modifies fluid pressure applied to the piston in order to control piston position, said apparatus being movable from a null position in response to a control force for changing fluid pressure applied to the piston to cause the piston to move so as to return said apparatus to said null position, said apparatus characterized by:

two valves; each valve is connected to a source of fluid and containing a movable element which controls fluid flow through the valve and which is resiliently connected to said piston; a first one of the valves has a negative rate relationship between fluid flow through the valve and the force needed to move the element; the second of the valves has a positive rate relationship between fluid flow through the valve and the force needed to move the element; and said elements are connected to each other so that as fluid flow through one valve is increased, fluid flow in the other valve is also increased.

2. A servo as described in claim 1 characterized in that:

each of the valves is of the flapper type; and the flappers for both valves are attached to an arm which can pivot and which is connected with a spring to the piston.

* * * * *